United States Patent [19]

Taylor

[11] Patent Number: 4,709,532

[45] Date of Patent: Dec. 1, 1987

[54] VERTICAL FORM-FILL SEAL PROCESS AND MACHINE WITH PRODUCT CATCHING DEVICE

[75] Inventor: Monroe F. Taylor, Greenville, S.C.

[73] Assignee: W. R. Grace & Co., Cryovac Div., Duncan, S.C.

[21] Appl. No.: 937,268

[22] Filed: Dec. 3, 1986

[51] Int. Cl.[4] ..... B65B 9/20; B65B 9/08

[52] U.S. Cl. ..... 53/451; 53/551; 53/552

[58] Field of Search ..... 53/551, 552, 554, 575, 53/576, 442, 451, 557

[56] References Cited

U.S. PATENT DOCUMENTS

| | | | |
|---|---|---|---|
| 3,045,404 | 7/1962 | Wilson | 53/551 |
| 3,262,244 | 7/1966 | Cutler et al. | 53/551 |
| 3,579,404 | 5/1971 | Spitznagel | 53/552 X |
| 3,668,815 | 6/1972 | Henry et al. | 53/551 X |
| 4,054,474 | 10/1977 | Collins, III et al. | 53/442 X |
| 4,532,752 | 8/1985 | Taylor | 53/551 X |
| 4,606,174 | 8/1986 | Berg | 53/551 X |

*Primary Examiner*—Horace M. Culver

*Attorney, Agent, or Firm*—John J. Toney; William D. Lee, Jr.; Mark B. Quatt

[57] ABSTRACT

A vertical form, fill, and seal process and apparatus for individually packaging easily bruised articles of produce such as apples, pears, tomatoes, etc. by catching each article as it is dropped through a tube of thermoplastic, heat sealable film and simultaneously sealing and severing the tube below the caught article without the article forceably contacting the hot seal or striking the heat sealing means.

6 Claims, 5 Drawing Figures

VERTICAL FORM-FILL SEAL PROCESS AND MACHINE WITH PRODUCT CATCHING DEVICE

FIELD OF THE INVENTION

The field of the present invention encompasses vertical form, fill and seal apparatus for packaging articles. In particular, the field of the present invention is directed to a vertical form, fill and seal apparatus which is adapted to individually package easily bruised articles of and produce such as, for example, apples, pears, tomatoes and the like. Even more particularly, the field of the present invention is directed to a vertical form, fill and seal apparatus for individually packaging easily bruised articles, as identified above, whereby the packaging or process of loading the articles into the package does not result in rupture of any of the transverse heat seals which form the package by closing the tube.

BACKGROUND OF THE INVENTION

The present invention relates to machines for forming, filling and sealing packages which are made from an elongated thin flat sheet of flexible packaging material. In general, the sheet of flexible packaging material is formed by the apparatus into a vertically depending, upwardly open tube having overlapping longitudinal edges. Thereafter, the overlapping edges are longitudinally sealed together by means well known to those in the art and the end of the tube is sealed together by a pair of transverse heat seals which are vertically spaced apart. At this point the tube is filled from above with a measured quantity of product. A second heat sealing operation, which is performed after the filled tube has been downwardly advanced, completes enclosure of the product. Simultaneously with or shortly after the transverse heat sealing step the tube is completely transversely severed by known cutting means in the space between the vertically spaced apart pair of transverse heat seals. Thereafter the tube is downwardly advanced and the cycle is successively repeated so as to form a multiplicity of individually packaged products.

Many means for advancing the vertically depending, upwardly open tube downwardly over the mandrel are conventional in the art. For example, as stated above, it has been conventional practice to employ heat sealing means for closing (e.g. sealing) the tube by forming a pair of vertically spaced apart transverse heat seals. In one conventional embodiment the sealing bars are moveable in both the horizontal and vertical planes. That is, the sealing bars are intermittently moved horizontally inwardly to engage and compress the tube and form a pair of vertically spaced apart transverse heat seals and are then moved vertically downwardly to feed or draw the packaging material over and past the tube forming mandrel. The transverse heat sealing of the tube occurs during this operation. Thereafter, the sealing bars move horizontally outwardly to release the tube and return vertically to their starting position.

A further conventional practice in advancing or feeding the packaging material over the mandrel involves the use of a vacuum belt mechanism. In this apparatus a pair of perforate endless belts are disposed respectively on opposite sides of the tube to engage and feed the tube downwardly as a result of a reduced pressure or vacuum condition at the openings in the belt. The tube closing or transverse heat sealing means in this arrangement may be stationary vertically but reciprocally moveable horizontally to intermittently engage and transversely heat seal the tube between feed and product drop or fill operations.

Yet another conventional practice for advancing or feeding the packaging material over the tube former or mandrel involves the use of pinch rollers rather than a belt mechanism. In this configuration two rollers are disposed respectively on opposite sides of the tube with the rollers engaging and feeding the tube downwardly over the mandrel as a result of the fact that the tube is pinchingly engaged between the rollers and the outer surface of the mandrel.

In all of the foregoing arrangements a relatively long "product drop" is encountered. This product drop is encountered as a result of the fact that the articles to be packaged must be introduced into the interior of the forming mandrel near the top thereof. This arrangement, of course, is necessary since the sheet of flexible packaging material is completely formed into a vertically depending tube shortly below the upper surface of the forming mandrel and access into the interior thereof cannot be gained below this point without destruction of the tubular configuration. Accordingly, the distance which the articles to be packaged must fall upon entrance into the interior of the tube forming mandrel and discharge therefrom is substantial. Additionally, with the vertically moveable transverse heat sealing arrangement the necessary vertical travel of the sealing bars results in a substantial further vertical distance through which an article must fall in the filling operation. Furthermore, it should be noted that in this configuration the portion of the formed tube immediately above the tube closing transverse sealing bars is in tension and drawn into a relative sharp or tight "V" configuration during the downward movement of the sealing bars. This configuration is not conducive to a good filling operation nor is the resulting stress at the sealing bars conducive to good sealing.

In the vacuum belt or pinch roller arrangement, the belts or rollers and sealing bar movements can be coordinated to provide for a relaxed condition of the tube above the sealing bars and a relatively shallow or a loose "V" configuration with a slight bulge or ballooning effect can be arrived at. Such a configuration is more conducive to a good filling operation. Transverse heat sealing may also efficiently be accomplished in the absence of stress. The operative run distance of the vacuum belts in that configuration, however, extend through a substantial vertical distance and a relative long product drop distance is, once again, encountered.

While a relatively long "product drop" may not be totally undesirable or unacceptable with articles which are of fairly light weight, it is completely unacceptable when attempting to package articles which are relatively heavy and easily bruised. In particular, a major problem which has developed in attempting to package relatively heavy easily bruised articles such as, for example, apples, pears, tomatoes and the like is that the articles, when introduced into the interior of the forming mandrel fall, under the influence of gravity, and impact the preformed transverse heat seals which are utilized to close the tube such that the transverse heat seals are ruptured. Of course, such a situation is wholly unacceptable. One prior art attempt to solve this problem is to keep the seal clamped between the seal bars so that the articles strike the seal bar rather than the seal. However, even with padded seal bars the impact of the article on the seal bar simply bruises or damages the article.

Accordingly, those of skill in the art have undertaken a quest to provide a vertical form, fill and seal apparatus which will individually package bruisable product articles without rupturing the transverse heat seals which close the tube as have occurred in the past attempts to package such articles. The present inventive apparatus and method provide a satisfactory and cost efficient solution to this outstanding problem.

OBJECTS OF THE PRESENT INVENTION

Accordingly, it is a general object of the present invention to overcome and thus obviate the problems encountered by those of skill in the art in attempting to utilize a vertical form, fill and seal machine to individually package easily bruised product articles such as apples, pears, peaches, tomatoes and the like.

It is another object of the present invention to provide a vertical form, fill and seal packaging apparatus which accomplishes the individual packaging of relatively heavy articles without rupturing the transverse tube closing end seals.

Yet a further object of the present invention is to provide a vertical form, fill and seal packaging machine and process which may be utilized to individually package easily damaged articles such as apples, pears, peaches, tomatoes and the like.

Still further objects and the broad scope of applicability of the present invention will become apparent to those of ordinary skill in the art from the details given hereinafter. However, it should be understood that the detailed description of the presently preferred embodiments of the present invention is given by way of illustration only since various changes and modifications well within the spirit and scope of the invention will become apparent to those of ordinary skill in the art in view of this detailed description.

SUMMARY OF THE PRESENT INVENTION

It has now been found that the above objects can be obtained in a vertical form, fill, and seal machine for individually packaging product articles in transversely sealed tubes formed from thermoplastic film wherein the improvement for packaging an easily bruised article comprises transverse heat sealing and severing means for simultaneously sealing the bottom of an upper package and the top of a lower package and severing the tubular film between said seal; and, catcher finger means associated with said heat sealing and severing means to prevent said article from striking the said heat sealing means as the article is vertically dropped into the tube.

In another aspect, the present invention is a vertical form, fill, and seal machine for individually packaging articles in thermoplastic film formed into a tube comprising a vertical mandrel and guide chute through which articles are dropped one-at-a-time and guided into said tube; a pair of sealing and severing bars located below said chute, one bar being on an opposed side of the tube from the other bar and the bars being mounted to make upper and lower transverse seals across the tube and to sever the tube transversely between said seals; and, catcher fingers on the upper surface of each of said seal bars for catching an article as the article drops through the tube and chute and the seal bars close, said catcher fingers preventing the article from striking the seal bars.

In still another aspect, the present invention is a vertical form, fill, and seal process for packaging easily bruised articles of produce comprising the steps of forming a sheet of thermoplastic material into a tube using a mandrel and vertically suspending the tube; providing and positioning a guide chute within the tube adjacent the upper opening of the tube; providing and positioning a pair of seal bars below said chute, the seal bars in said pair being positioned on opposed sides of said tube whereby when said seal bars are closed they will transversely seal and sever said tube so that the lower end of the upper portion of said tube is sealed and the upper end of the lower portion of the tube is likewise sealed; providing catcher fingers on the upper surfaces of said seal bars to catch an article as it is dropped through said chute before it strikes a seal bar as the seal bar is moved towards the tube to compress, seal and sever same; dropping a first article of produce through said chute; closing said seal bars together to catch the first article with the catcher fingers before the article strikes the seal bars and simultaneously sealing and severing the tube as the bars close; moving the seal bars apart so that the article in the tube may pass therebetween as it is released from the fingers; feeding an additional length of tube to lower the article below the seal bars; repeating the steps of dropping the article of produce and closing the seal bars using a second article of produce whereby the first article is packaged in a length of tubing sealed at each end and the resulting package is severed from the tube.

In yet another aspect, the present invention is a vertical form, fill, seal process for packaging easily bruised produce articles in a tube formed from a sheet of thermoplastic, heat sealable material comprising the steps of: dropping an article of produce through said tube; and simultaneously transversely heat sealing the tube below the article and catching and holding the article before it can contact the portion of the tube being heat sealed or contact a seal bar.

In each of the foregoing aspects of the present invention as a process, the steps of providing a deflate hole or holes in the film tube, employing heat shrinkable film to form the package; and thereafter heating the film to shrink it tightly around the article is included.

DESCRIPTION OF THE DRAWINGS

The present invention may be better understood by the drawings appended hereto which are made a part of this disclosure and are included for illustrative purposes in which.

DESCRIPTION OF THE PREFERRED EMBODIMENTS

Figure 1:
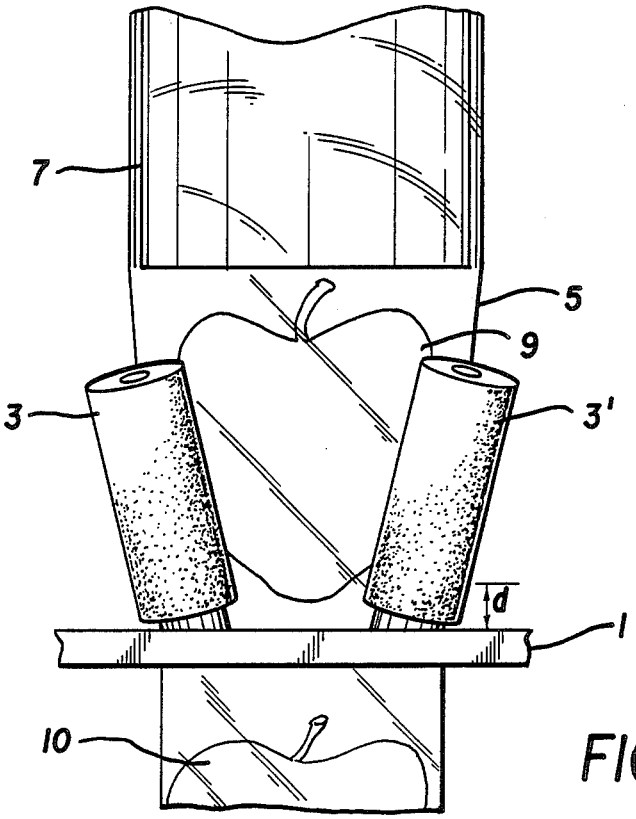
FIG. 1 is a representation of a partial elevation view of the apparatus of the present invention showing an easily bruised article of produce, namely, an apple, being held by the catcher fingers of the present invention.

The present invention is directed to an improvement in and to presently existing and well known vertical form, fill and seal machines. To improve clarity and avoid confusion reference to this well-known type of machinery is accomplished by incorporation by reference of exemplary non-limiting examples of this type of machine. In particular, this type of machine is illustrated in U.S. Pat. No. 4,322,929 to Newmann; U.S. Pat. No. 4,291,520 to Prince; U.S. Pat. No. 4,288,965 to James; 4,277,302 to Reid; U.S. Pat. No. 4,274,244 to Gilbert; U.S. Pat. No. 4,144,693 to Ogata and U.S. Pat. No. 4,118,913 to Putnam. All of these patents are hereby incorporated by reference. These patents generally disclose that it has heretofore been well known to provide a vertical form, fill and seal machine for packaging articles wherein the machine comprises (1) mandrel means having an upper article entrance orifice, an interior and a lower article discharge orifice with the mandrel means being adapted to receive a sheet of flexible plastic packaging material and progressively to form the sheet into a vertically depending and upwardly open tube having overlapping longitudinal edges whereby the lower discharge orifice communicatively connects the interior of the mandrel with the interior of the tube; (2) longitudinal sealing means adapted to longitudinally seal the overlapping edges of the sheet together; (3) tube advance means adapted to downwardly advance the tube; (4) upper and lower heat sealing means adapted to sealingly close the tube below the article discharge orifice by forming two vertically spaced apart transverse heat seals across the tube; and (5) cutting means adapted to sever the tube in the space between said transverse heat seals of special interest is my form, fill, seal machine described and claimed in U.S. Pat. No. 4,532,752 which issued on Aug. 6, 1985 and is incorporated herein by reference.

Turning now to the attached figures, the apparatus and process of this invention will be described. Looking first a FIG. 5 a vertical form, fill, and seal apparatus is schematically represented in a partial section of a front elevation view. A roll 19 of flat sheet thermoplastic film 5' is shown being threaded over guide roll 15 and then under spreader roll 14 which allows the film 5' to be formed by mandrel or tube forming chute 16 into tube 5 which is enclosed around guide chute 6. The edges of the film sheet as the film is folded over mandrel 16 are lapped over to form a tube which is held in place by collar 17. Below collar 17 the lapped over portions are sealed together longitudinally of the tube by electrostatic sealer 18. This tube is then advanced downwardly to feed more of the tube as it is consumed by packaging products or articles. The mandrel 16 and the upper part of the guide chute 6 act together to form the tube 5 as the tube is, of course, formed around the guide chute 6. All of the foregoing is well within the skill of those experienced in the art of form, fill, seal packaging.

Figure 5:
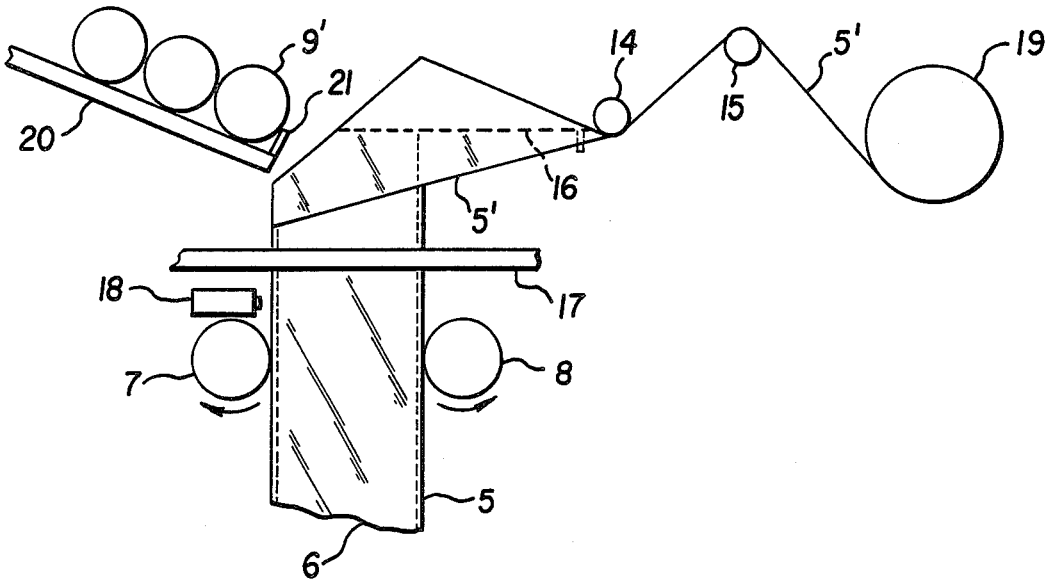

Still continuing with FIG. 5, loading ramp 20 is shown with spherical objects 9' being held from rolling under the influence of gravity by gate 21. A product or article 9' represents an article of produce which is easily bruised and require gentle handling. The articles 9' are represented as spheres for convenience. The gate 21 can be any well known device for dispensing articles one-at-a-time and may apply restraint from above or from the sides rather than below as illustrated. In some instances, it may be desirable to manually dispense the items at this point. In any event, the articles are dropped into the open end of the tube 5 from roughly the position of the gate 21.

Figure 2:
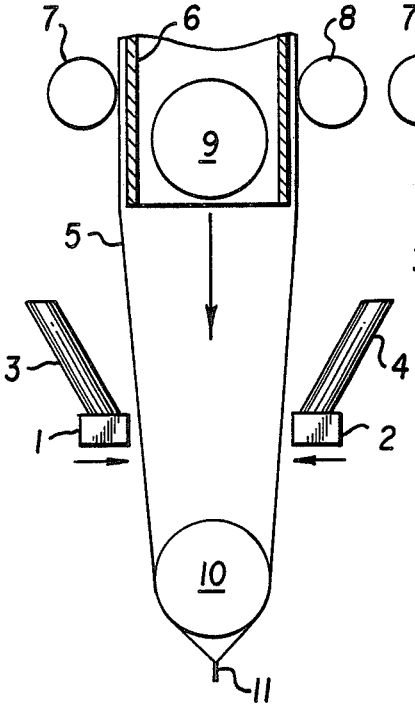
FIGS. 2, 3, 4 show an schematic representation the steps of catching an article and sealing and severing the tube; and, FIG. 5 shows a partial front elevation view schematically represented of the loading of articles into the vertically formed and held tube as it is formed.
Figure 3:
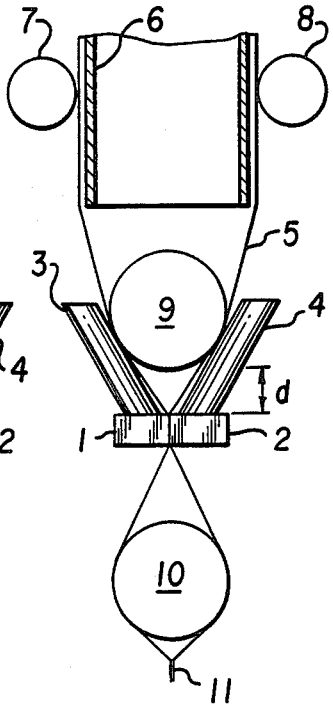
Figure 4:
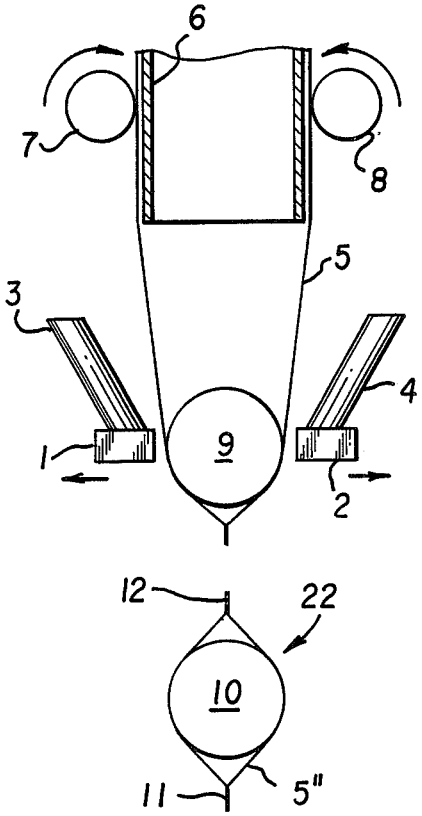

Turning now to FIGS. 2 through 4 the sequential operation of the apparatus of the present invention and likewise the process of the present invention will be explained. In FIG. 2, tube 5 is shown transversely sealed at the bottom of the tube by seal 11 which holds article 10 at the bottom of the tube. Seal bars 1 and 2 are disposed above the product 10 and are positioned on opposed sides of tube 5. When the seal bars 1 and 2 which comprise the pair of seal bars are closed they will transversely seal and sever the tube so that the lower end of the upper portion of the tube 5 is sealed and the upper end of the lower portion of the tube is likewise sealed. In other words, two transverse parallel seals are made at this point. The seal bars are also provided with a transverse severing wire which is heated above the sealing temperature of the film so that it will cut by melting the film in a thin line between the seals. Alternately, one wide seal can be made and a heated wire can cut through the entire seal.

Carried on seal bars 1 and 2 are catcher finger means 3 and 4 which are preferably located on the upper surface of the seal bars and are covered with resilient material such as sponge rubber. In a preferred embodiment a second finger 3' identical to finger 3 would be located on bar 1 immediately behind bar 3 as viewed in FIG. 2 and spaced down the length of the bar a distance appropriate for the particular size of the articles 9 and 10 being packaged. (See FIG. 1). A similar second finger 4' (not shown) is provided on bar 2 spaced down the bar from the finger 4 in the same manner that fingers 3 and 3' are spaced apart on bar 1. Preferably, the spacing between the fingers and the angle which fingers 3, 3' and 4, 4' present with the horizontal is adjustable by mounting the fingers on slotted plates (not shown) with hold down bolts (not shown) through the slots so that the fingers may be moved up and down the length of the bar and in and out toward the tube. A single catcher means could be substituted for the fingers so that just one very wide finger or "hand" is presented on each side but experience to date indicates that four catcher fingers work quite well for most products in the size and weight range of premium sized apples, pears, and peaches and the four finger combination is readily adjusted.

Still viewing FIG. 2, chute 6 is seen disposed within tube 5 with free falling product 9 at the point where it is discharged from chute 6. Film advance rollers 7 and 8 when rotated feed an additional length of tubing downwardly.

Turning now to FIG. 3, seal bars 1 and 2 have been moved inwardly to compress a portion of tube 5 therebetween and with the application of heat ad pressure seal the film transversely across the width of the tube thus closing the top of the lower portion which encloses product 10 and the bottom of the upper portion which will be the closure for product 9. The seal bars are of a conventional nature and are well known in the art. The seal bar temperature and dwell time when closed differ with the polymeric made up of each film. The means for moving the seal bars inwardly is preferably pneumatic cylinders which are not shown but which can be positioned to drive the bars together. The pneumatic cylinders are actuated by solenoid operated switches and can move inwardly and outwardly rapidly. The closing of the seal bars begins when gate 21 (FIG. 5) is actuated to admit one article 9 which falls freely until it is caught by fingers 3, 3' and 4, 4' which, being covered with resilient, sponge-like material, preferably sponge rubber, cushion the fall. It is desirable to make the height of the chute or, rather, the distance between the discharge end of ramp 20 (FIG. 5) adjacent gate 21 and the point at which the article 9 will be caught by fingers 3, 3' and 4, 4' in FIG. 3 as short as practical. In FIG. 3 the article 9 is caught a distance "d" above seal bars 1 and 2 so that it does not strike the seal bars and become bruised or damaged thereby. In addition, by catching the article 9 above the seal no stress is put on the seal immediately and the material has time to completely fuse before the weight of article 9 bears against the seal.

In FIG. 4, package 22 comprises article 10, the lower severed portion of the tube 5 which is designated 5" and which is closed by lower seal 11 and upper seal 12. This leaves product 9 in the tube 5 held by the bottom seal 13. Since product 9 falls only a relatively short distance "d" when the seal bars 1 and 2 are removed from their position shown in FIG. 3, there is very little stress or force applied to the still warm seal 13. Thus, the catcher fingers serve the purpose of not only preventing the falling product 9 from striking the seal bar and becoming bruised or damaged, the catcher fingers also divide the fall into two stages so that the second and final fall of the product against the bottom seal is a very short fall. Furthermore, this second fall takes place while tube advance rolls 7, 8 are feeding additional tube length downwardly. The result being that very little force is applied against the seal 13.

Turning now to FIG. 1, the side view from FIGS. 2 through 4 is shown. In FIG. 1, the second finger 3' is shown spaced down the seal bar from finger 3 which is seen in FIGS. 2 through 4. Products which especially benefit from the packaging method and apparatus of this invention are apples, pears, and peaches.

Package 22 in FIG. 4 will preferably fall a short distance onto a cushioned conveyor to be carried to a heat shrinking tunnel. The conveyor surface is ribbed with sponge rubber or like resilient material arranged so that the package will be cushioned as it lands on the conveyor and not roll.

In the heat shrinking tunnel, streams of hot air are directed against the film material of tube 5" to shrink the tube material, which is preferably heat shrinkable, tightly around the product. The previously provided deflate holes allow trapped air to escape as the film shirnks.

It is to be understood that variations and modifications of the present invention may be made without departing from the scope of the present invention. It is also to be understood that the scope of the invention is not to be interpreted as limited to the specific embodiments disclosed herein, but only in accordance with the appended claims when read in the light of the foregoing disclosure.

I claim:

1. In a vertical form, fill, and seal machine for individually packaging product articles in transversely sealed tubes formed from thermoplastic film, the improvement for packaging an easily bruised article comprising:

(a) transverse heat sealing and severing means for simultaneously sealing the bottom of an upper package and the top of a lower package and severing the tubular film between said seals; and, (b) catcher finger means associated with said sealing and severing means to catch and hold said individual article thereby preventing said article from striking either the bottom seal or transverse compression of the tube immediately below the held article or from striking the heat sealing means as the article is vertically dropped into the tube and thereby holding said article spaced vertically from said transverse compression or seal area.

2. The vertical form, fill, and seal machine of Claim 1 wherein the catcher finger means are located on the upper surface of the sealing and severing means and said finger extend upwardly from and diverge outwardly from said sealing and severing means.

3. A vertical form, fill, and seal machine for individually packaging articles in thermoplastic film formed into a tube comprising:

(a) a vertical mandrel and guide chute through which articles are dropped one-at-a-time and guided into said tube;

(b) a pair of sealing and severing bars located below said chute, one bar being on an opposed side of the tube from the other bar and the bars being mounted to compress the tube between them and make upper and lower transverse seals across the tube and sever the tube transversely between said seals; and, (c) catcher fingers on the upper surface s of each of said seal bars extending upwardly and diverging outwardly from said tube for catching an article as the article drops through the tube and chute and the seal bars close, said catcher fingers preventing the article from striking the seal bars and holding the article vertically spaced above the seal bars.

4. The vertical form-fill-seal machine of claim 3 wherein each sealing bar in said pair is provided with two catcher fingers on each upper surface extending upwardly and away from the tube, each of said catcher fingers being covered with a resilient material.

5. A vertical form, fill, seal process for individually packaging easily bruised produce articles in a tube formed from a sheet of thermoplastic, heat sealable material comprising the steps of:

(a) dropping an article of produce through said tube; and, (b) simultaneously transversely compressing the tube to heat seal same below the article with a pair of opposed seal bars and catching and holding one article at a time before the article can contact the portion of the tube being heat sealed or contact a seal bar, there being only one point of transverse compression of the tube during said process.

6. In a vertical form-fill-seal process in which a product is dropped through a vertically held tube of heat sealable thermoplastic material which is closed at its bottom end by a transverse seal made by heat sealing means, the improvement which comprises:

(a) catching the product prior to its striking the seal and means for sealing whereby the product is held only a relatively short distance above the seal; thereafter, (b) releasing the product to fall the remaining distance to the bottom of the tube whereby the product for the first time during said process is held by a transverse compression of the tube; and, (c) simultaneously with releasing the product, feeding additional tube material downwardly.

* * * * *